US012747543B2

(12) United States Patent
Richards et al.

(10) Patent No.: US 12,747,543 B2
(45) Date of Patent: Sep. 29, 2026

(54) CONSTRUCTION TOOL HANDLE

(71) Applicant: MILWAUKEE ELECTRIC TOOL CORPORATION, Brookfield, WI (US)

(72) Inventors: Ian C. Richards, Shorewood, WI (US); Travis S. Mergener, Horicon, WI (US); Katherine A. Flaherty, Brookfield, WI (US); Evan M. Glanzer, Milwaukee, WI (US); Allison M. Neuser, Wauwatosa, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 18/748,922

(22) Filed: Jun. 20, 2024

(65) Prior Publication Data

US 2024/0426066 A1 Dec. 26, 2024

Related U.S. Application Data

(60) Provisional application No. 63/593,572, filed on Oct. 27, 2023, provisional application No. 63/519,488, filed on Aug. 14, 2023, provisional application No. 63/510,020, filed on Jun. 23, 2023.

(51) Int. Cl.
*E01C 19/40* (2006.01)

(52) U.S. Cl.
CPC ..... *E01C 19/402* (2013.01)

(58) Field of Classification Search
CPC ..... E01C 19/402; E01C 16/437; E01C 16/43; E01C 16/431; E01C 16/429; E01C 404/113; E01C 404/114; E01C 404/117
See application file for complete search history.

(56) References Cited

U.S. PATENT DOCUMENTS

| | | | | |
|---|---|---|---|---|
| 1,573,458 | A * | 2/1926 | Smith | E21B 17/04 16/431 |
| 2,737,094 | A | 3/1956 | Corwill | |
| 2,885,861 | A | 5/1959 | Corwill | |
| 3,199,424 | A | 8/1965 | Glass | |
| 3,232,188 | A | 2/1966 | Frohnauer, Jr. | |
| 3,236,164 | A | 2/1966 | Miller | |

(Continued)

FOREIGN PATENT DOCUMENTS

| | | |
|---|---|---|
| CN | 2761690 Y | 3/2006 |
| CN | 2837369 Y | 11/2006 |

(Continued)

*Primary Examiner* — Chuck Y Mah
(74) *Attorney, Agent, or Firm* — Michael Best & Friedrich LLP

(57) ABSTRACT

A handle for a construction tool includes a lower handle portion configured to be coupled to the construction tool, an upper handle portion coupled to the lower handle portion, a handlebar coupled to the upper handle portion and configured to be grasped by a user during operation of the construction tool, and a vibration isolating joint positioned between the handlebar and the upper handle portion. The vibration isolating joint isolates the handlebar from vibration transmitted to the upper handle portion from the construction tool. The vibration isolating joint provides a first degree of freedom to the handlebar relative to the upper handle portion and a different, second degree of freedom to the handlebar relative to the upper handle portion.

23 Claims, 17 Drawing Sheets

(56) References Cited

U.S. PATENT DOCUMENTS 3,543,655 A 12/1970 Uebel
3,759,624 A 9/1973 Hundey et al.
3,832,080 A 8/1974 Stoecker
4,071,922 A * 2/1978 Davies, III ..... A01B 33/08 280/47.371
4,113,403 A 9/1978 Tertinek et al.
4,156,576 A 5/1979 Clavel et al.
4,282,938 A * 8/1981 Minamidate ..... F16F 7/104 173/162.2
4,335,566 A * 6/1982 Hurd ..... G05G 5/005 56/11.8
4,609,055 A * 9/1986 Grafstrom ..... B25D 17/043 16/431
4,835,949 A * 6/1989 Seyerle ..... A01D 34/6806 56/11.1
4,895,478 A 1/1990 Artzberger
5,119,632 A * 6/1992 Nishimura ..... F16H 61/439 60/494
5,340,233 A 8/1994 Motl
5,645,370 A 7/1997 Zurbes et al.
6,019,179 A 2/2000 Zurbes
6,098,492 A * 8/2000 Juchniewicz ..... B62B 9/20 74/555
6,213,673 B1 4/2001 Jungwirth et al.
6,267,532 B1 7/2001 Persson
6,409,426 B1 6/2002 Maclellan
6,551,022 B1 4/2003 Stayner
6,588,977 B1 7/2003 Stayner
6,749,365 B2 6/2004 Sina et al.
6,863,479 B2 * 3/2005 Frauhammer ..... B25D 17/043 173/162.2
7,039,986 B2 5/2006 Glenn et al.
7,175,365 B1 2/2007 Breeding
7,392,568 B2 * 7/2008 Koschel ..... B25F 5/026 16/436
7,540,336 B2 6/2009 Steffen
7,753,621 B2 7/2010 Steffen
7,845,442 B2 * 12/2010 Akazawa ..... B62D 51/06 56/10.8
8,123,432 B1 2/2012 Steffen
8,182,173 B2 5/2012 Lickel
8,316,510 B2 * 11/2012 Anraku ..... A01D 34/824 16/437
8,708,599 B2 4/2014 Steffen
9,010,452 B2 4/2015 Williamson et al.
9,611,596 B2 4/2017 Becker et al.
9,695,566 B2 7/2017 Braun
9,861,021 B2 1/2018 Modzik et al.
10,053,873 B2 8/2018 Grinwald
2004/0040729 A1 * 3/2004 Meixner ..... B25D 17/043 173/162.2
2004/0234337 A1 11/2004 Burkert et al.
2006/0207063 A1 9/2006 Jaszkowiak et al.
2006/0272130 A1 12/2006 Togami et al.
2007/0107165 A1 * 5/2007 Oddo ..... B25F 5/006 16/431
2007/0151074 A1 7/2007 Whiteman, Jr. et al.
2008/0121065 A1 * 5/2008 Yanai ..... A01B 33/028 74/491
2008/0185163 A1 * 8/2008 Becht ..... B25D 17/043 173/162.1
2009/0035065 A1 2/2009 Gavins
2010/0296869 A1 11/2010 Catanzarite et al.
2011/0211910 A1 * 9/2011 Argento ..... E01C 19/402 404/118
2012/0251241 A1 10/2012 Sperfslage
2012/0312572 A1 * 12/2012 Nemetz ..... B25F 5/006 248/220.22
2013/0004237 A1 1/2013 Krings et al.
2014/0260839 A1 * 9/2014 Hurley ..... B25F 5/026 81/489
2014/0262400 A1 9/2014 Berger et al.
2015/0298312 A1 10/2015 Williamson et al.
2021/0220984 A1 * 7/2021 Sandwall ..... B23D 47/005
2022/0018073 A1 1/2022 Mizuguchi et al.
2022/0256767 A1 * 8/2022 Colber, Jr ..... A01D 34/824
2023/0030584 A1 2/2023 Rodriguez et al.

FOREIGN PATENT DOCUMENTS

CN 201202110 Y 3/2009
CN 201202111 Y 3/2009
CN 201294749 Y * 8/2009
CN 102162238 A 8/2011
CN 202519570 U 11/2012
CN 202688984 U 1/2013
CN 202809594 U * 3/2013
CN 203066054 U 7/2013
CN 103850240 A 6/2014
CN 203668909 U 6/2014
CN 203668910 U 6/2014
CN 204097840 U 1/2015
CN 204608747 U 9/2015
CN 204690559 U 10/2015
CN 204728309 U 10/2015
CN 105040673 A 11/2015
CN 204780538 U 11/2015
CN 204803871 U 11/2015
CN 105332333 A 2/2016
CN 205062623 U 3/2016
CN 205171334 U 4/2016
CN 205259168 U 5/2016
CN 105019424 B 6/2017
CN 206308685 U 7/2017
CN 107354849 A 11/2017
CN 206680987 U 11/2017
CN 206722417 U 12/2017
CN 206752266 U 12/2017
CN 206844094 U 1/2018
CN 207073052 U 3/2018
CN 207159987 U 3/2018
CN 207259917 U 4/2018
CN 207348045 U 5/2018
CN 207484451 U 6/2018
CN 207538021 U 6/2018
CN 108286339 A 7/2018
CN 207608792 U 7/2018
CN 207685638 U 8/2018
CN 108677914 A 10/2018
CN 207959177 U 10/2018
CN 208039223 U 11/2018
CN 208105894 U 11/2018
CN 208346793 U 1/2019
CN 208363074 U 1/2019
CN 208441076 U 1/2019
CN 208455603 U 2/2019
CN 109555103 A 4/2019
CN 208777293 U 4/2019
CN 109750654 A 5/2019
CN 208884502 U 5/2019
CN 208884503 U 5/2019
CN 209162588 U 7/2019
CN 209816821 U 12/2019
CN 209923906 U 1/2020
CN 210341878 U 4/2020
CN 210368924 U 4/2020
CN 210368925 U 4/2020
CN 210421064 U 4/2020
CN 210509404 U 5/2020
CN 210529674 U 5/2020
CN 210886843 U 6/2020
CN 111455782 A 7/2020
CN 211171912 U 8/2020
CN 211228449 U 8/2020
CN 211596736 U 9/2020
CN 211872642 U 11/2020
CN 211872961 U 11/2020
CN 212426645 U 1/2021
DE 1941695 U 6/1966
DE 8219668 U1 10/1982
DE 10007869 C1 * 8/2001 ..... E02D 3/046
DE 202006008542 U1 9/2006

(56) References Cited

FOREIGN PATENT DOCUMENTS

| | | | | | |
|---|---|---|---|---|---|
| DE | 202009000264 | U1 | | 3/2009 | |
| DE | 202009001177 | U1 | | 5/2009 | |
| DE | 202009004301 | U1 | | 11/2009 | |
| DE | 102007003927 | B4 | | 12/2013 | |
| DE | 102014007559 | A1 | | 11/2015 | |
| DE | 102016105950 | A1 | | 10/2017 | |
| EP | 703320 | A2 | | 3/1996 | |
| EP | 662371 | B1 | | 4/1997 | |
| EP | 1026322 | A1 | * | 8/2000 | ..... E01C 19/38 |
| EP | 1127983 | B1 | | 4/2005 | |
| EP | 1557495 | B1 | | 6/2011 | |
| EP | 2357283 | B1 | | 6/2013 | |
| EP | 2940213 | B1 | | 10/2018 | |
| GB | 2086005 | A | * | 5/1982 | ..... F16F 7/116 |
| JP | 2006169759 | A | * | 6/2006 | |
| JP | 2012044976 | A | * | 3/2012 | ..... A01D 34/905 |
| WO | WO2020202585 | A1 | | 10/2020 | |

* cited by examiner

CONSTRUCTION TOOL HANDLE

CROSS-REFERENCE TO RELATED APPLICATIONS

This application claims priority to U.S. Provisional Patent Application No. 63/593,572, filed on Oct. 27, 2023, U.S. Provisional Patent Application No. 63/519,488, filed on Aug. 14, 2023, and U.S. Provisional Patent Application No. 63/510,020, filed on Jun. 23, 2023, the entire contents of each of which is incorporated herein by reference.

FIELD OF THE DISCLOSURE

The present disclosure relates to walk-behind construction equipment, and more particularly to handles for walk-behind construction equipment.

BACKGROUND OF THE DISCLOSURE

Many types of construction equipment, such as plate compactors, require an operator to walk behind the equipment to manually control movement of the equipment. These types of construction equipment typically include handles to provide the operator a control mechanism for the construction equipment.

SUMMARY OF THE DISCLOSURE

The present disclosure provides, in one aspect, a handle for a construction tool including a lower handle portion configured to be coupled to the construction tool, an upper handle portion coupled to the lower handle portion, a handlebar coupled to the upper handle portion and configured to be grasped by a user during operation of the construction tool, and a vibration isolating joint positioned between the handlebar and the upper handle portion. The vibration isolating joint isolates the handlebar from vibration transmitted to the upper handle portion from the construction tool. The vibration isolating joint provides a first degree of freedom to the handlebar relative to the upper handle portion and a different, second degree of freedom to the handlebar relative to the upper handle portion.

The present disclosure provides, in another aspect, a handle for a construction tool including a lower handle portion configured to be coupled to the construction tool, an upper handle portion coupled to the lower handle portion, a handlebar coupled to the upper handle portion, and a counterweight assembly disposed within the upper handle portion and configured to attenuate vibration transmitted to the handlebar from the construction tool. The counterweight assembly includes an upper tension spring, a lower tension spring, and a counterweight coupled between the upper and lower tension springs. The counterweight is configured to reciprocate out of phase with vibration transmitted to the upper handle portion from the construction tool.

The present disclosure provides, in yet another aspect, a handle for a construction tool including a lower handle portion configured to be coupled to the construction tool, an upper handle portion coupled to the lower handle portion, a primary handlebar coupled to the upper handle portion, and a secondary handlebar coupled to the primary handlebar via a vibration isolating joint configured to provide a first degree of freedom of movement of the secondary handlebar relative to the primary handlebar and a second degree of freedom of movement of the secondary handlebar relative to the primary handlebar. The second degree of freedom of movement being different than the first degree of freedom of movement.

Other features and aspects of the disclosure will become apparent by consideration of the following detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
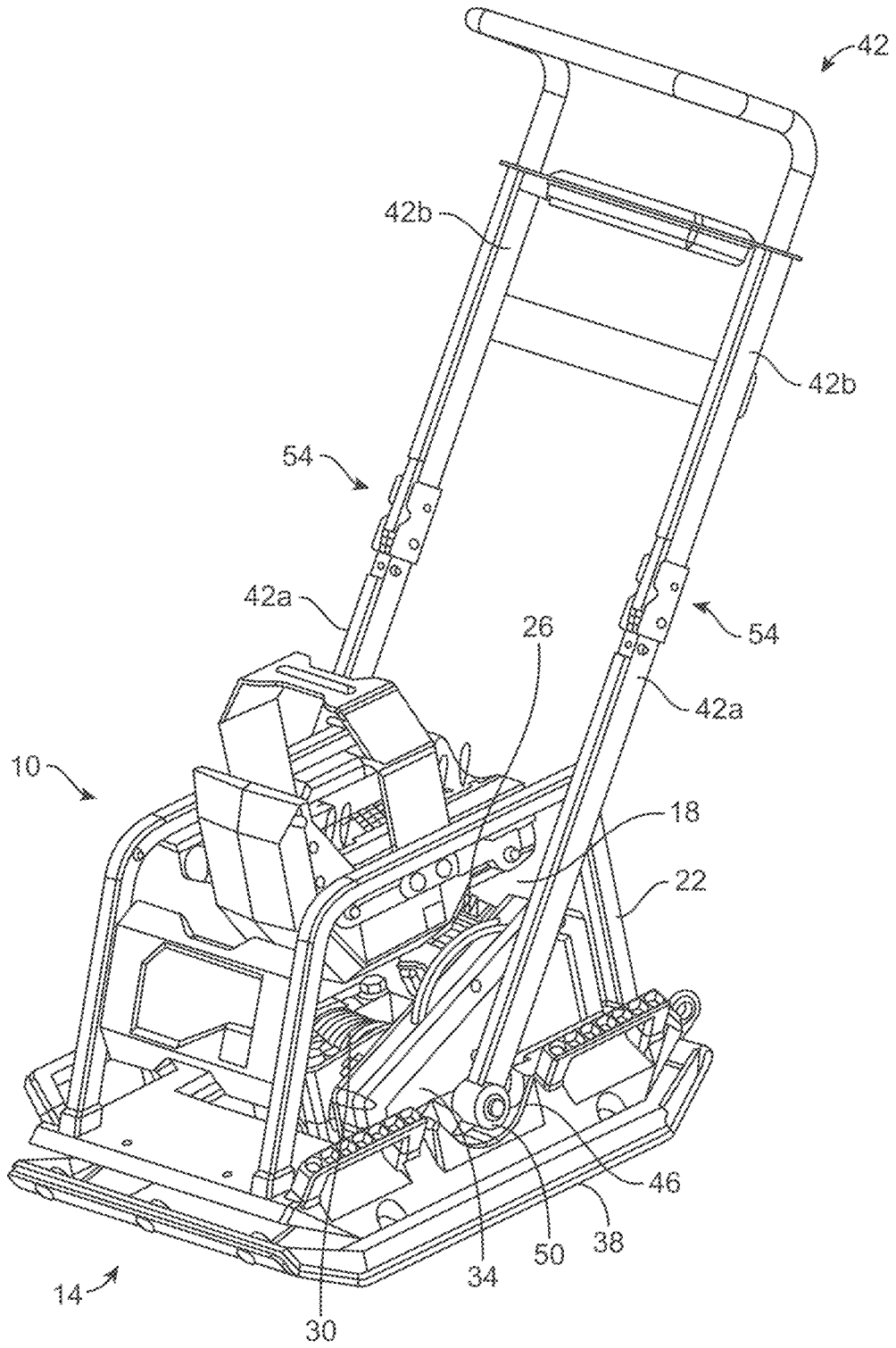
FIG. 1 is perspective view of a construction tool, such as a plate compactor, in accordance with an embodiment of the present disclosure.

With reference to FIG. 1 of the drawings, a type of walk-behind construction equipment, illustrated as a vibratory plate compactor 10, includes a base 14, a vibration mechanism 18 mounted upon the base 14, and a frame 22 coupled to the base 14 via vibration damping elements (e.g., rubber bushings, not shown). The vibration mechanism 18 includes an electric motor 26 (e.g., a brushless DC electric motor) and an eccentric shaft 30 driven by the motor 26 via a belt or chain drive 34. Alternatively, the motor 26 may directly drive the eccentric shaft 30 without an intervening belt or chain drive 34. The base 14 includes a compacting plate 38 such that rotation of the eccentric shaft 30 by the motor 26 induces a vibrating motion on the compacting plate 38 in a vertical direction.

Figure 2:
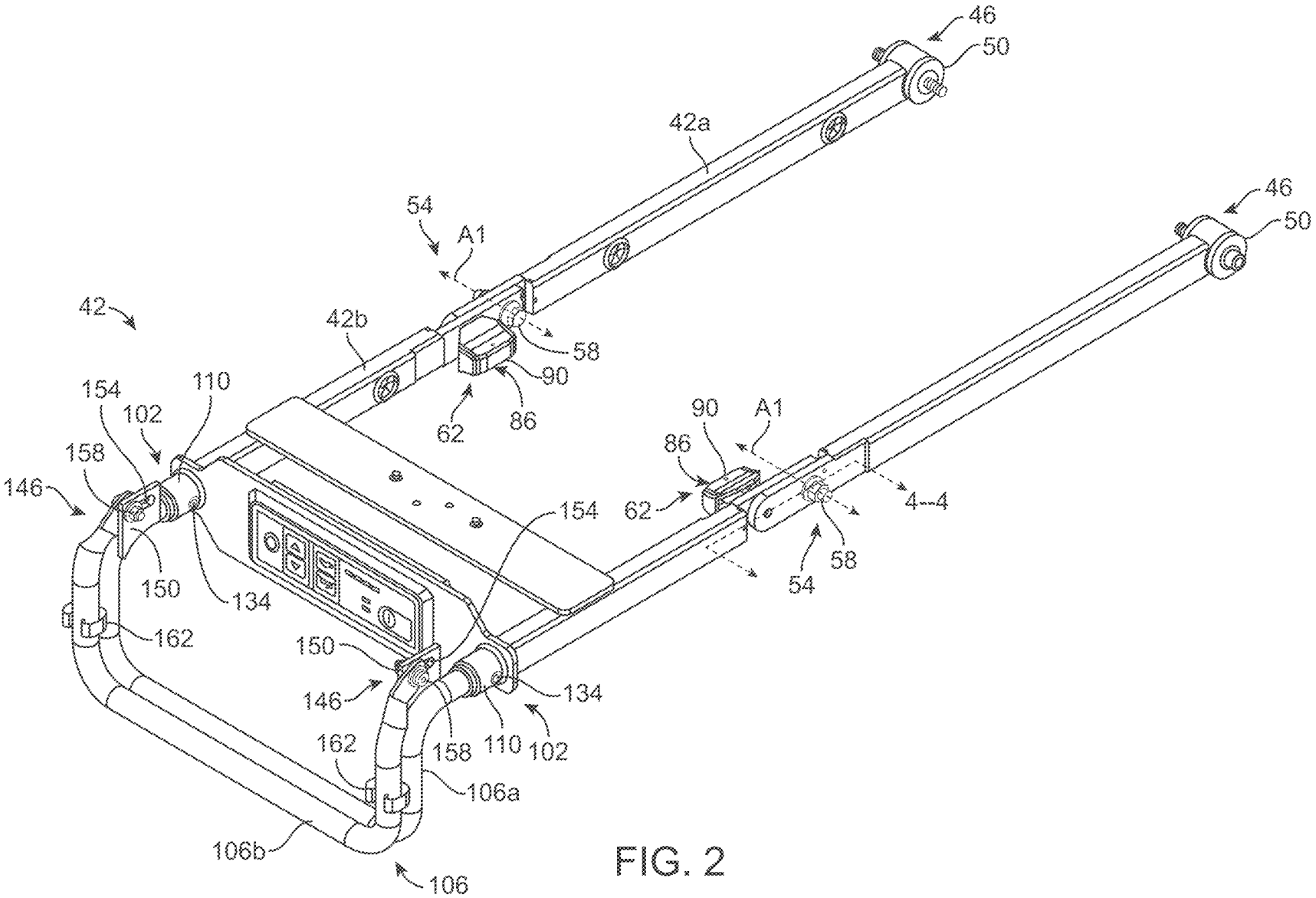
FIG. 2 is a perspective view of a handle for use with the plate compactor of FIG. 1.
Figure 3:
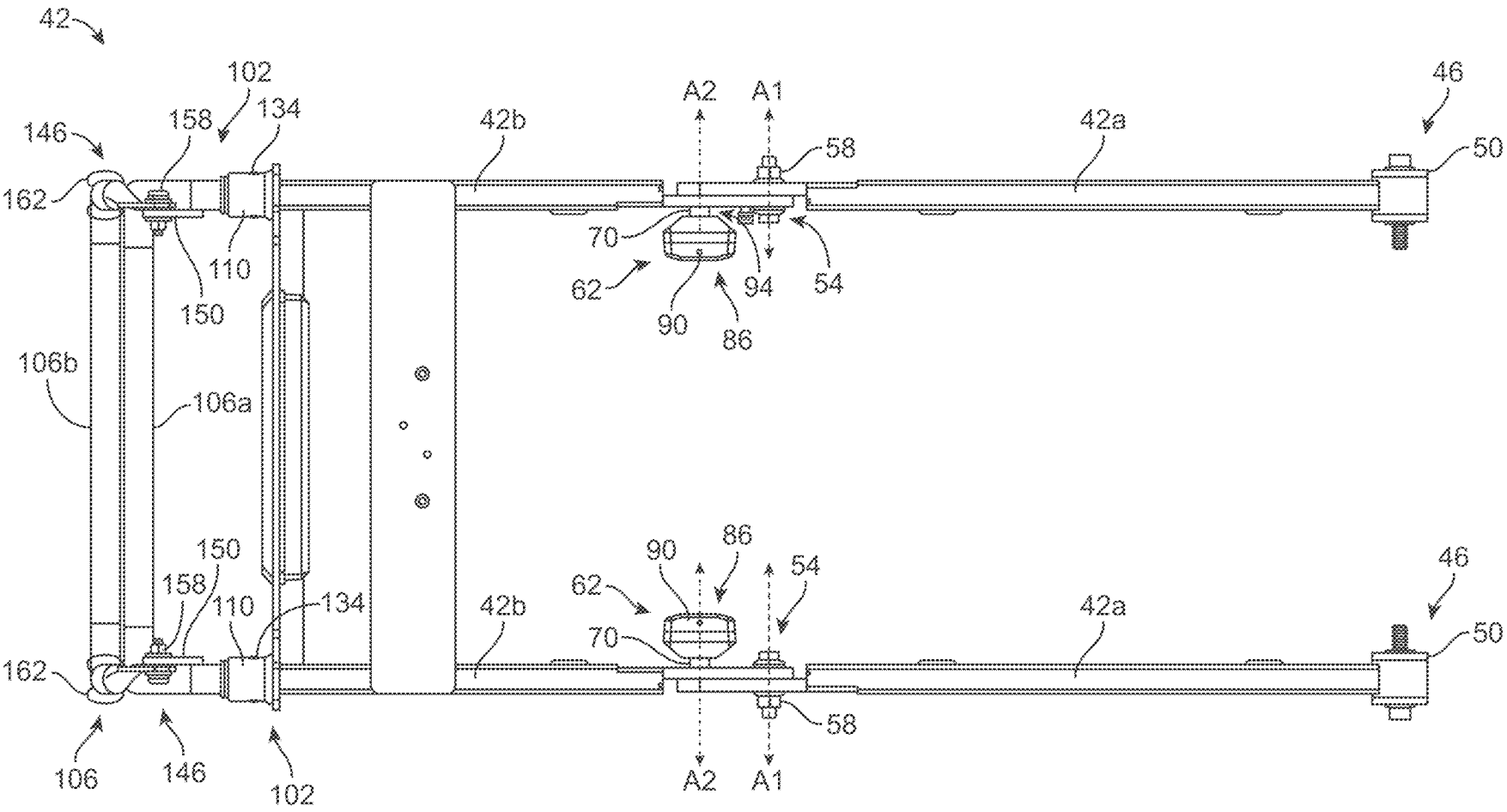
FIG. 3 is a plan view of the handle of FIG. 2.
Figure 4:
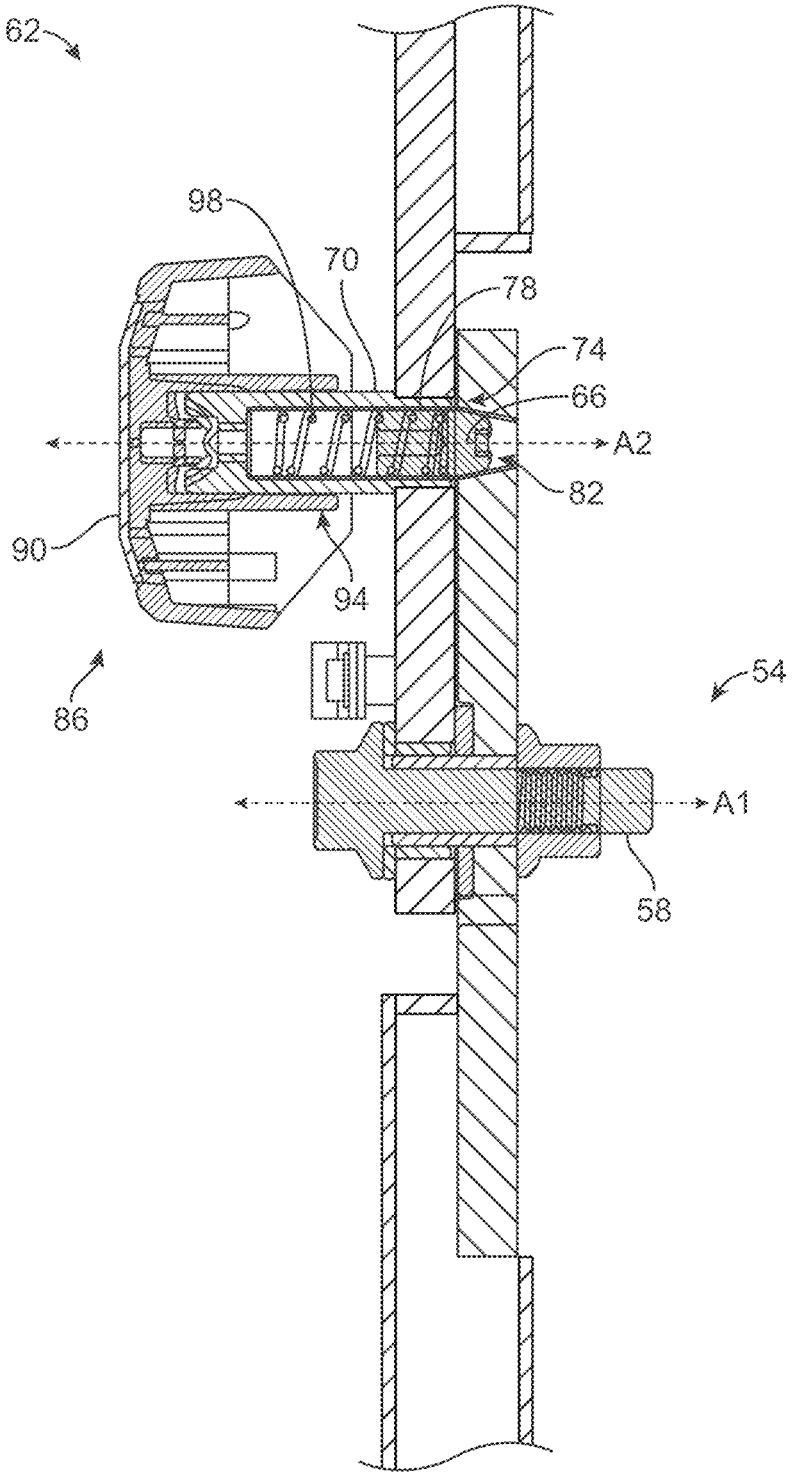
FIG. 4 is cross-sectional view of a portion of the handle of FIG. 2, taken along section line 4-4 in FIG. 2.

The vibratory plate compactor 10 includes a handle 42 (FIG. 1) coupled to opposite sides of the frame 22 at respective mounts 46 to permit an operator to guide the vibratory plate compactor 10 along a work surface. A bushing 50 on both ends of the handle 42 connects the handle 42 to the frame 22 in such a way that the handle 42 can pivot relative to the base 14 and the frame 22. The bushing 50 may be formed from PM brass, rubber, or other elastomeric materials. With reference to FIGS. 2-4, the handle 42 is hinged and foldable into a storage position when the compactor is not in use. The handle 42 includes a lower handle portion 42*a* pivotally coupled to the frame 22. An upper handle portion 42*b* is connected to the lower handle portion 42*a* by pivot joints 54. The pivot joints 54 allow the upper handle portion 42*b* to rotate relative to the lower handle portion 42*a* between a collapsed, storage position, and an extended, deployed position.

Referring to FIGS. 3 and 4, each pivot joint 54 includes a support pin 58 to couple the upper handle portion 42*b* to the lower handle portion 42*a*. The support pin 58 secures the upper handle portion 42*b* relative to the lower handle portion 42*a* while allowing the upper handle portion 42*b* to rotate relative to the lower handle portion 42*a* about a longitudinal axis A1 of the support pin 58. In the illustrated embodiment, the support pins 58 of each pivot joint 54 are oriented such that their longitudinal axes A1 extend laterally with respect to the construction equipment 10 and parallel to an axis of rotation of the lower handle portion 42*a* relative to the frame 22.

A locking mechanism 62 is coupled to each pivot joint 54 to selectively secure the upper handle portion 42*b* in the deployed position. The locking mechanism 62 includes an inner locking pin 66 (FIG. 4) to selectively rotationally lock the upper handle portion 42*b* in the deployed position relative to the lower handle portion 42*a*. The inner locking pins 66 are supported by the upper handle portion 42*b*, define a longitudinal axis A2 that is oriented parallel to the support pins 58, and are spaced apart from the support pins 58. In the illustrated embodiment, the inner locking pins 66 are spaced from the support pins 58 in a direction toward the upper handle portion 42*b*. The inner locking pins 66 are moveable along the longitudinal axis A2 between a lock position and an unlock position. In the lock position, the inner locking pin 66 engages both the upper handle portion 42*b* and the lower handle portion 42*a*. Therefore, the inner locking pin 66 prevents the upper handle portion 42*b* from rotating relative to the lower handle portion 42*a* about the support pin 58. In the unlock position, the inner locking pin 66 is displaced along its longitudinal axis A2 (e.g., inwards relative to the plate compactor 10) such that the lower handle portion 42*a* is no longer engaged by the inner locking pin 66. Accordingly, the upper handle portion 42*b* is rotatable relative to the lower handle portion 42*a* about the support pin 58.

Referring again to FIG. 4, each locking mechanism 62 includes an outer locking pin guide 70 disposed about the inner locking pin 66. The outer locking pin guide 70 is a hollow cylindrical body that is fixed relative to the upper handle portion 42*b*. The inner locking pin 66 includes an exterior end 74 and an interior end 78. The exterior end 74 is frustoconical and engageable with a frustoconical bore 82 within the lower handle portion 42*a* when the inner locking pin 66 is in the lock position. In other embodiments, the exterior end 74 and the bore 82 may have non-frustoconical shapes so long as the shape of the exterior end 74 corresponds with the shape of the bore 82. The interior end 78 is coupled to a release handle 86 that controls movement of the inner locking pin 66 between the lock and unlock positions. The release handle 86 is affixed to and moves in unison with the inner locking pin 66 as the inner locking pin 66 translates between the lock and unlock positions. The release handle 86 includes a user graspable portion 90 that, in the illustrated embodiment, forms a cross-bar or T-shape and a locking pin support portion 94 that is coaxial with the longitudinal axis A2 of the inner locking pin 66 and coupled to the inner locking pin 66. The locking pin support portion 94 is formed as a hollow, cylindrical body that surrounds a portion of the outer locking pin guide 70 and is movable relative to the outer locking pin guide 70. Disposed between the inner locking pin 66 and the outer locking pin guide 70 is a biasing member 98, illustrated as a compression spring, that biases the inner locking pin 66 and the release handle 86 towards the lock position.

To rotate the upper handle portion 42*b* relative to the lower handle portion 42*a*, an operator displaces the inner locking pins 66 by grasping the user-graspable portion 90 of the release handle 86 and moving the release handle 86 towards the unlock position. Movement of the release handle 86 results in movement of the inner locking pin 66 against the biasing force of the compression spring 98 within the outer locking pin guide 70 to disengage the inner locking pin 66 from the lower handle portion 42*a*, thereby unlocking the locking mechanism 62 and allowing the upper handle portion 42*b* to rotate relative to the lower handle portion 42*a*.

As previously mentioned, the handle 42 is intended to be used in conjunction with a type of walk-behind construction equipment, such as a plate compactor 10, and the plate compactor 10 operates by inducing a vibrating motion on the compacting plate 38. Accordingly, the handle 42 of the present disclosure further includes a vibration damping mechanism 102 to attenuate vibration transmitted to the operator along a vibration transmission pathway (e.g., from the vibration mechanism 18 to the handle 42) and therefore, reduce the effects of the vibrating motion on the operator (e.g., to reduce fatigue).

Figure 5:
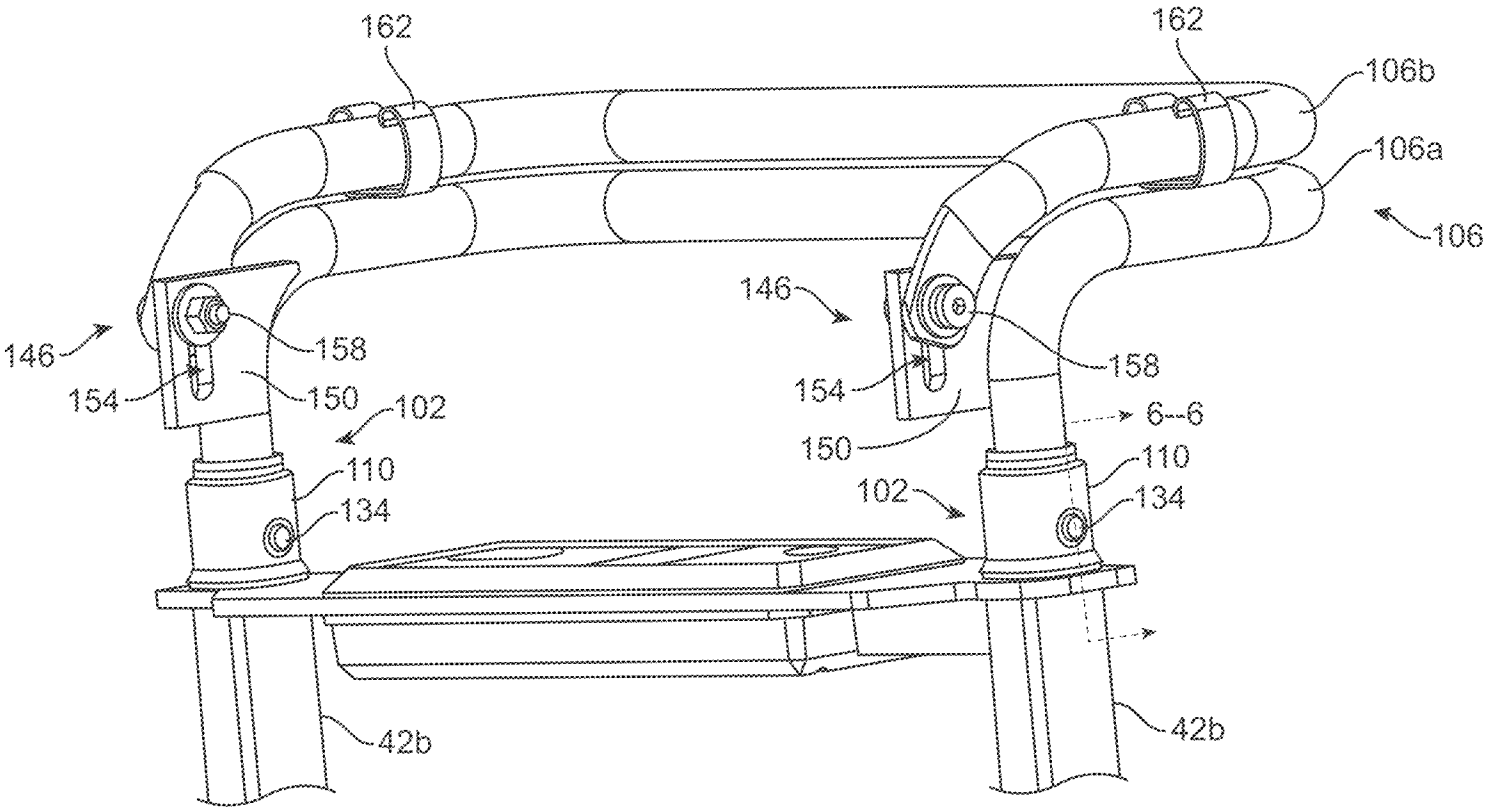
FIG. 5 is an enlarged perspective view of a portion of the handle of FIG. 2.
Figure 6:
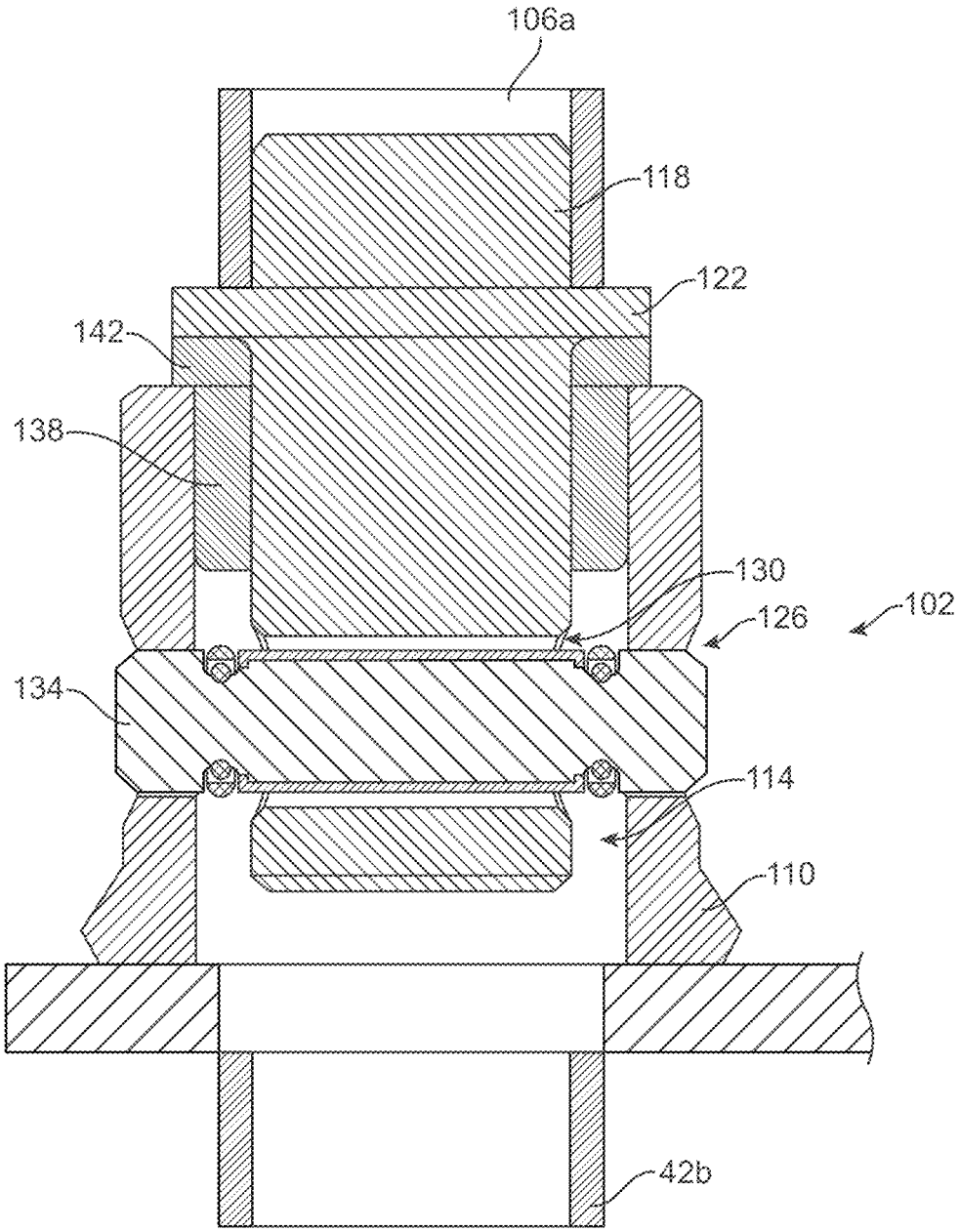
FIG. 6 is a cross-sectional view of a portion of the handle of FIG. 2, taken along section line 6-6 in FIG. 5

Referring now to FIGS. 5 and 6, the vibration damping mechanism 102 couples the upper handle portion 42*b* to a handlebar 106, illustrated as a U-shaped handlebar, which the operator may hold while controlling the plate compactor 10. The vibration damping mechanism 102 of the illustrated embodiment allows a relatively small amount of pivoting movement between the handlebar 106 and the upper handle portion 42*b* (e.g., less than 5 degrees of rotation). More particularly, the vibration damping mechanism 102 includes a pair of sockets 110 fixedly coupled to the upper handle portion 42*b*. The sockets 110 of the illustrated embodiment are part of the upper handle portion 42*b* and define a hollow, cylindrical interior volume 114. In other embodiments the sockets 110 may define an interior volume that is non-cylindrical in shape. The vibration damping mechanism 102 further includes a pair of protrusions 118 extending from the handlebar 106. In the illustrated embodiment, the protrusions 118 are separately formed from the handlebar 106 and fixedly coupled to the handlebar 106. In other embodiments, the protrusions 118 may be integrally formed with the handlebar 106. The protrusions 118 are cylindrical in shape and sized to be smaller than the interior volume 114 of the sockets 110. Thus, the protrusions 118 are receivable within the interior volume 114 of the sockets 110. In the illustrated embodiment, a flange 122 extends radially from each protrusion 118 to align the protrusion 118 relative to the handlebar 106. The flange 122 may also limit the extent to which the protrusion 118 may be inserted into the socket 110.

With continued reference to FIGS. 5 and 6 the socket 110 includes an aperture 126 extending laterally therethrough (e.g., parallel to the longitudinal axis A1). The protrusion 118 includes a corresponding aperture 130 extending laterally therethrough. A pivot pin 134 is secured within the apertures 126, 130 to position the handlebar 106 relative to the upper handle portion 42*b*. The pivot pin 134 couples the handlebar 106 to the upper handle portion 42*b* while allowing limited relative movement between the handlebar 106 and the upper handle portion 42*b*. More particularly, the protrusion 118 is rotatable about the pivot pin 134 within the confines of the interior volume 114 of the socket 110. The relative movement is constrained by the size difference between the protrusion 118 and the socket 110.

Finally, the vibration damping mechanism 102 includes a damper 138 disposed between the protrusion 118 and the socket 110. The damper 138 is formed of a type of rubber or other elastomeric material and has a hollow, cylindrical shape. The damper 138 is disposed about a portion of the protrusion 118. In the illustrated embodiments, the damper 138 further includes a flange portion 142 that extends radially and is positioned to abut against the flange 122 of the protrusion 118. Accordingly, the flanges 142, 122 of the damper 138 and the protrusion 118, respectively, position the damper 138 relative to the protrusion 118. The damper 138 is sized to fill, or mostly fill, the space between the protrusion 118 and the socket 110. Therefore, as the protrusion 118, and thus the handlebar 106, rotates relative to the socket 110 and the upper handle portion 42*b*, the damper 138 compresses. Compression of the damper 138 attenuates vibration that is transmitted to the handlebar 106 during operation of the plate compactor 10.

Referring now to FIG. 5, the handle 42 also includes a vibration isolating joint 146 to further decrease the effects of vibrations from the plate compactor 10 on an operator. Two vibration isolating joints 146 are positioned between the handlebar 106 (at each end) and the upper handle portion 42*b* and allow for further movement of the handlebar 106 relative to the upper handle portion 42*b* to isolate the handlebar 106 from vibration transmitted to the upper handle portion 42*b* from the plate compactor 10. More particularly, the handlebar 106 of the illustrated embodiment is a primary handlebar 106*a*, and the handle 42 includes a secondary handlebar 106*b* coupled to the primary handlebar 106*a*. The secondary handlebar 106*b* is movable relative to the primary handlebar 106*a* via the vibration isolating joints 146 to isolate the operator, when grasping only the secondary handlebar 106*b*, from vibration transmitted through the upper handle portion 42*b*.

Extending from each side of the primary handlebar 106*a* is a support plate 150. The support plate 150 is fixed to the primary handlebar 106*a* and includes a slot 154 therein. The secondary handlebar 106*b* is coupled to the slot 154 and is movable relative to the primary handlebar 106*a*. A fastener 158, such as a shank bolt or pin, extends through the slot 154 and is slidably received within the slot 154 to couple the secondary handlebar 106*b* to the support plates 150. The fasteners 158 allow the secondary handlebar 106*b* to rotate relative to the primary handlebar 106*a*. The fasteners 158 further allow the secondary handlebar 106*b* to translate relative to the primary handlebar 106*a*, because the fastener 158 is translatable within the slot 154. In some embodiments, the slot 154 may be disposed on the secondary handlebar 106*b* and the fastener 158 may be disposed on the primary handlebar 106*a*. Accordingly, the secondary handlebar 106*b* is capable of rotating and translating relative to the primary handlebar 106*a* during operation of the plate compactor 10 to reduce the amount of vibration that is transmitted to the operator.

In other words, the vibration isolating joint 146 provides a first degree of freedom to the secondary handlebar 106*b* relative to the upper handle portion 42*b* and a different second degree of freedom to the secondary handlebar 106*b* relative to the upper handle portion 42*b*. The first degree of freedom is rotation, and the second degree of freedom is translation. Because the primary handlebar 106*a* is positioned upstream of the vibrating isolating joints 146 relative to a force transmission path of the vibration transmitted through the upper handle portion 42*b*, the primary handlebar 106*a* is not isolated from vibration. However, the vibration damping mechanisms 102 attenuate vibration transmitted to the primary handlebar 106*a* from the upper handle portion 42*b*.

In the illustrated embodiment, the secondary handlebar 106*b* is selectively securable in a stowed position (FIG. 5) in which the secondary handlebar 106*b* is not movable relative to the primary handlebar 106*a*. The stowed position allows an operator to move and/or operate the plate compactor 10 via the primary handlebar 106*a*, thereby bypassing the vibration isolating joints 146. In the illustrated embodiment, a pair of clips 162 are coupled to the primary handlebar 106*a* and operable to selectively secure the secondary handlebar 106*b* relative to the primary handlebar 106*a*. In other embodiments, the secondary handlebar 106*b* may be secured to the primary handlebar 106*a* via other securement mechanisms (e.g., fasteners or magnets).

Figure 7:
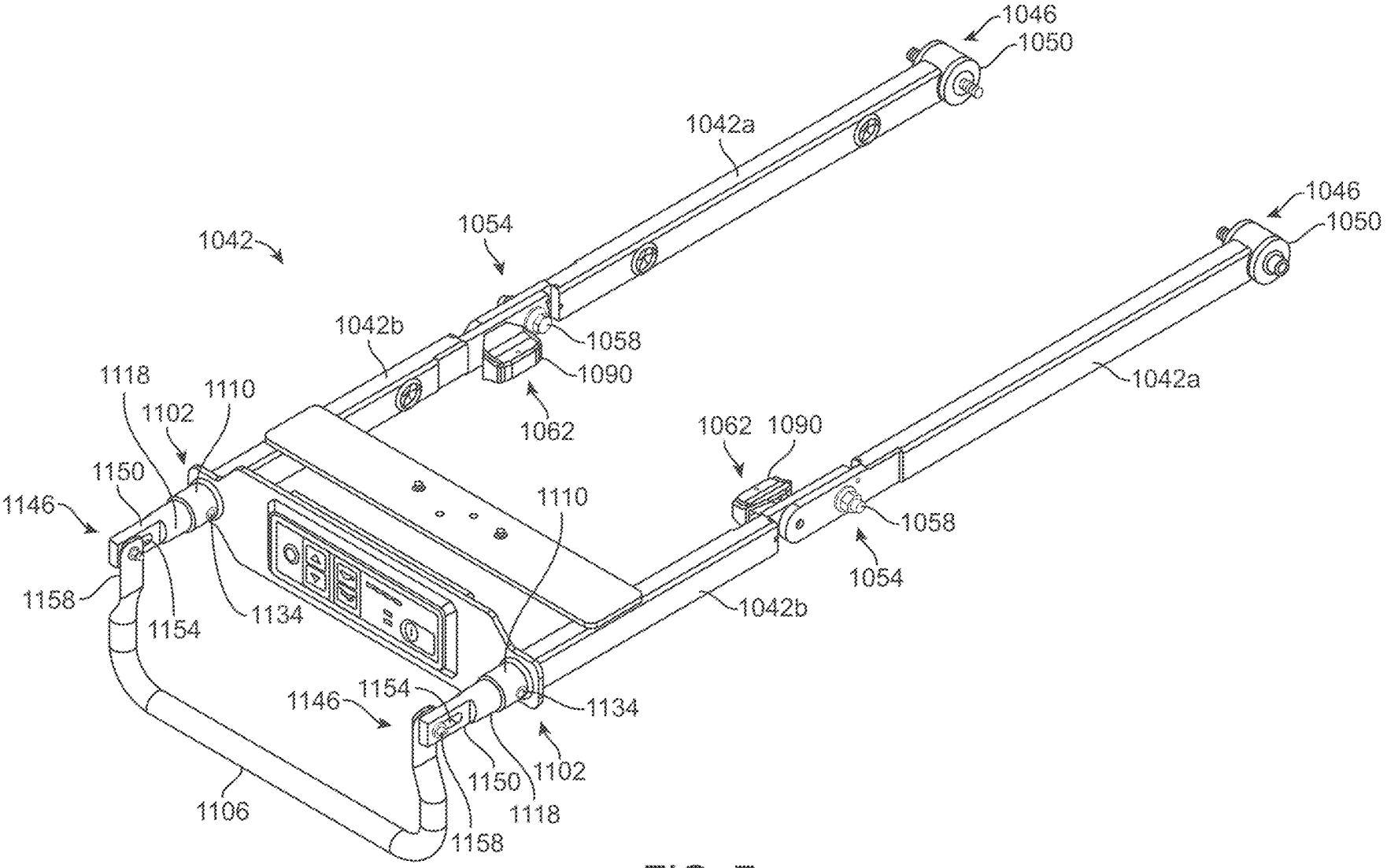
FIG. 7 is a perspective view of another embodiment of a handle for use with the plate compactor of FIG. 1.
Figure 8:
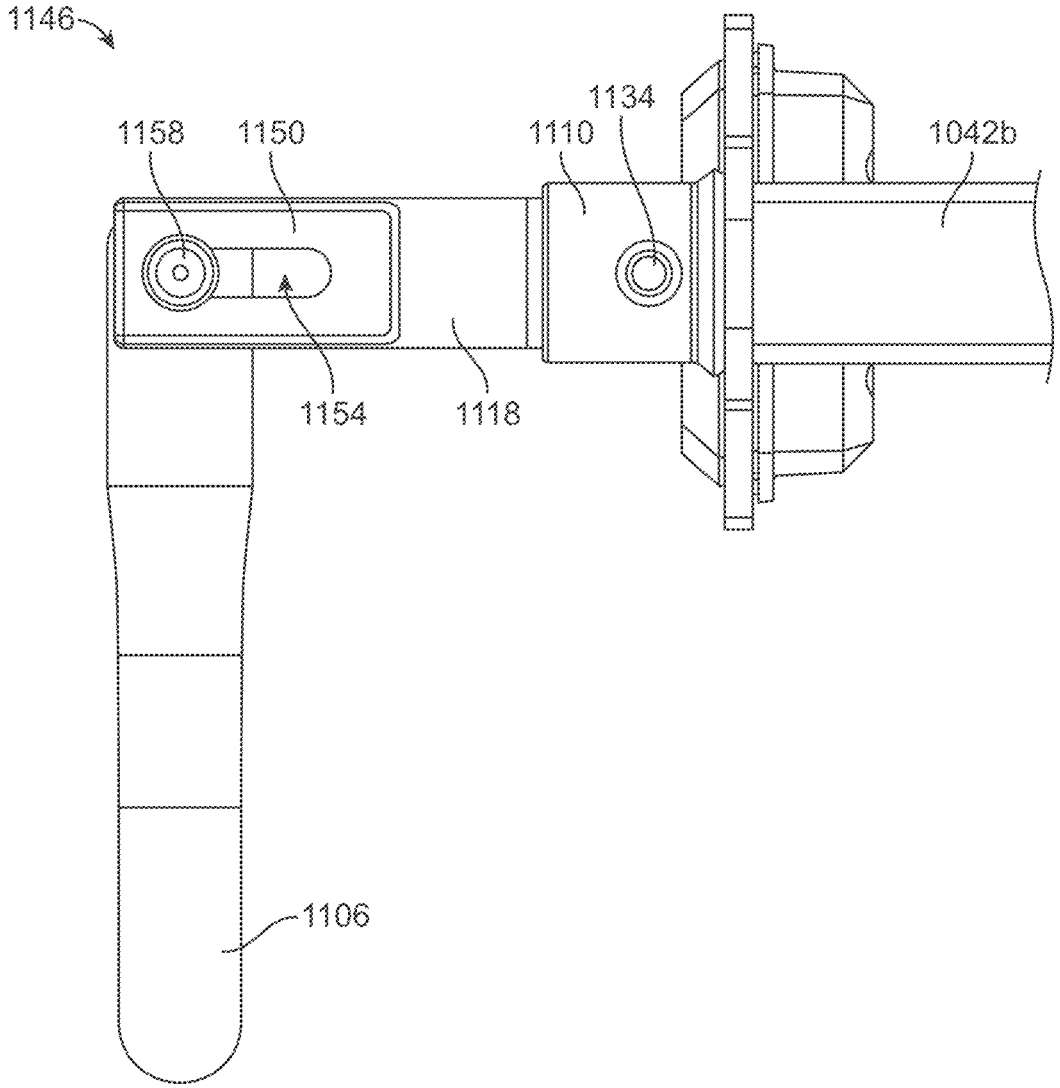
FIG. 8 is an enlarged plan view of a portion of the handle of FIG. 7.

FIGS. 7 and 8 illustrate a handle 1042 for use with the plate compactor 10 including another embodiment of a vibration isolating joint 1146, with like parts having like reference numerals plus 1000 and the following differences explained below. Rather than utilizing a secondary handlebar 106*b*, the vibration isolating joint 1146 is disposed between the vibration damping mechanism 1102 and the handlebar 1106. Thus, the handlebar 1106 is provided with a first degree of freedom relative to the upper handle portion 1042*b* (i.e., rotation) and a second, different, degree of freedom relative to the upper handle portion 1042*b* (i.e., translation). The support plate 1150, including the slot 1154, is integrally formed with each protrusion 1118 and positioned at an opposite end of the protrusion 1118 relative to the portion that extends into the socket 1110. In the illustrated embodiment, the slot 1154 extends generally parallel to a longitudinal extent of the upper handle portion 1042*b*. The handlebar 1106 is then coupled to the support plate 1150 via the fastener 1158 (e.g., shank bolts). Accordingly, the handlebar 1106 is rotatable about the fastener 1158 and translatable within the slot 1154 (e.g., parallel to the upper handle portion 1042*b*) so as to be movable relative to the upper handle portion 1042*b*. In some embodiments, the vibration isolating joint 1146 may further include a securement mechanism (not shown) to secure the handlebar 1106 relative to the upper handle portion 1042*b* for an operator to bypass the vibration isolating joint 1146. In other words, in some embodiments the handlebar 1106 may be secured in a desired orientation relative to the upper handle portion 1042*b*, such as transverse to the upper handle portion 1042*b*.

Figure 9:
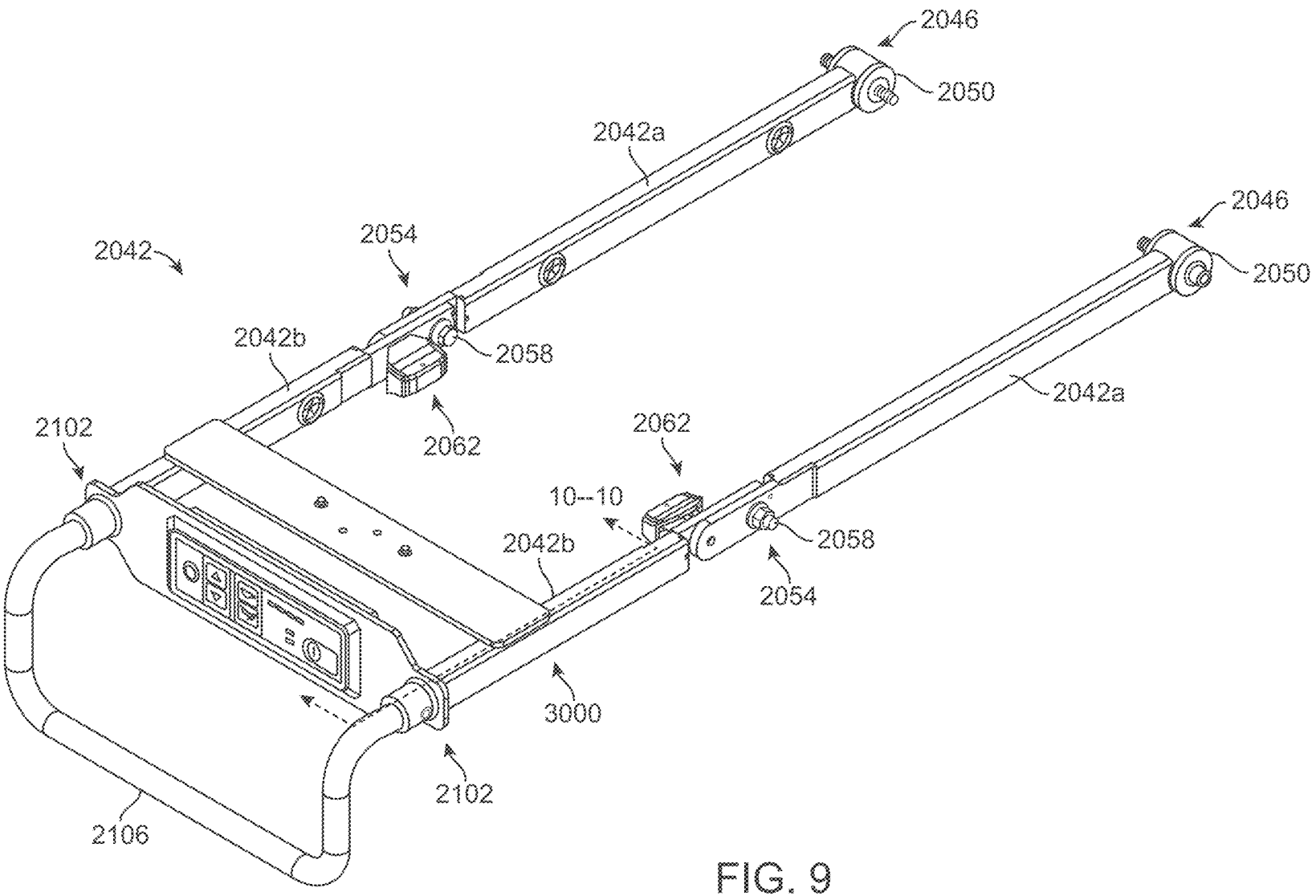
FIG. 9 is a perspective view of yet another embodiment of a handle for use with the plate compactor of FIG. 1.
Figure 10:
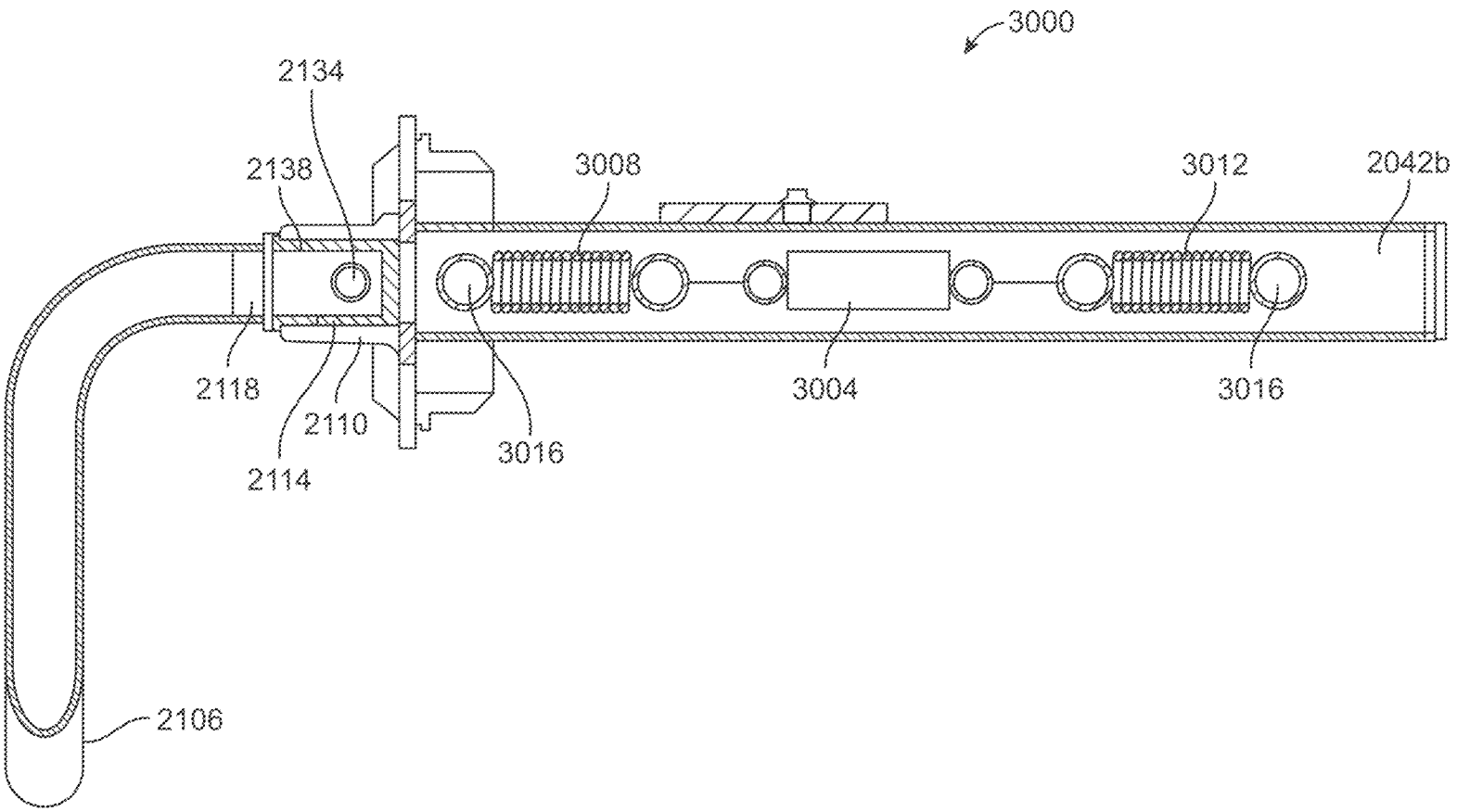
FIG. 10 is a cross-sectional view of a portion of the handle of FIG. 9, taken along section line 10-10 in FIG. 9.

FIGS. 9 and 10 illustrate yet another embodiment of a handle 2042 for use with the plate compactor 10 in accordance with the present disclosure, with like parts having like reference numerals plus 2000 and the following differences explained below. Rather than having a vibration isolating joint, the handle 2042 includes a counterweight assembly 3000. The counterweight assembly 3000 attenuates vibration transmitted from the plate compactor 10 to the handlebar 2106. In the illustrated embodiment, the upper handle portions 2042*b* are hollow, and the counterweight assembly 3000 is a counterweight-spring system that is disposed within the upper handle portions 2042*b*. Referring to FIG. 10, the counterweight assembly 3000 includes a counterweight 3004 suspended between an upper tension spring 3008 and a lower tension spring 3012. The counterweight 3004 is movable within the upper handle portion 2042*b* to counteract vibrations generated during use of the plate compactor 10. In the illustrated embodiment, the counterweight 3004 is suspended between the upper tension spring 3008 and the lower tension spring 3012 and movable approximately 2.5 inches between the upper and lower tension springs 3008, 3012. As the counterweight 3004 moves towards the upper tension spring 3008, the lower tension spring 3012 stretches, applying a progressively increasing force on the counterweight 3004 to cause it to decelerate. Similarly, as the counterweight 3004 moves towards the lower tension spring 3012, the upper tension spring 3008 stretches, applying a progressively increasing force on the counterweight 3004 to cause it to decelerate. Each of the upper and lower tension springs 3008, 3012 is secured at one end (i.e., opposite ends) to the upper handle portion 2042*b* via a pin or fastener 3016 and are coupled at the other end to the counterweight 3004. As the plate compactor 10 vibrates during operation, the counterweight 3004 moves between the upper and lower tension springs 3008, 3012 to counteract the vibrations. In other words, the counterweight 3004 reciprocates out of phase with vibration transmitted to the upper handle portion 2042*b* from the construction tool 10 to counteract the vibrations.

While the counterweight assembly 3000 has been described with reference to a handle 2042 that does not include a vibration isolation joint, it should be understood that counterweight assembly 3000 can be implemented along with either of the above-described implementations of the vibration isolation joint 146, 1146.

FIGS. 11-16 illustrate another embodiment of the handle 4042 for use with the plate compactor 10 in accordance with the present disclosure, the handle 4042 generally corresponds with the handle 42 as shown in FIGS. 2 and 3 and therefore only the differences will be described in detail herein. Like parts having like reference have used similar numerals plus 4000.

The handle 4042 includes a secondary handle assembly 4500. The secondary handlebar 4106*b* is movable relative to the primary handlebar 4106*a* via the vibration isolating joints 4548 to isolate the operator, when grasping only the secondary handlebar 4106*b*, from vibration transmitted through the upper handle portion 4042*b*. During use, the secondary handlebar 4106*b* is adjustable between a stowed position (see FIG. 15), in which the handlebar 4106*b* is fixedly secured to the handle 4042, and a deployed position (see FIG. 16), in which the handlebar 4106*b* is movable relative to the handle 4042 along two or more degrees of freedom (discussed below).

Figure 11:
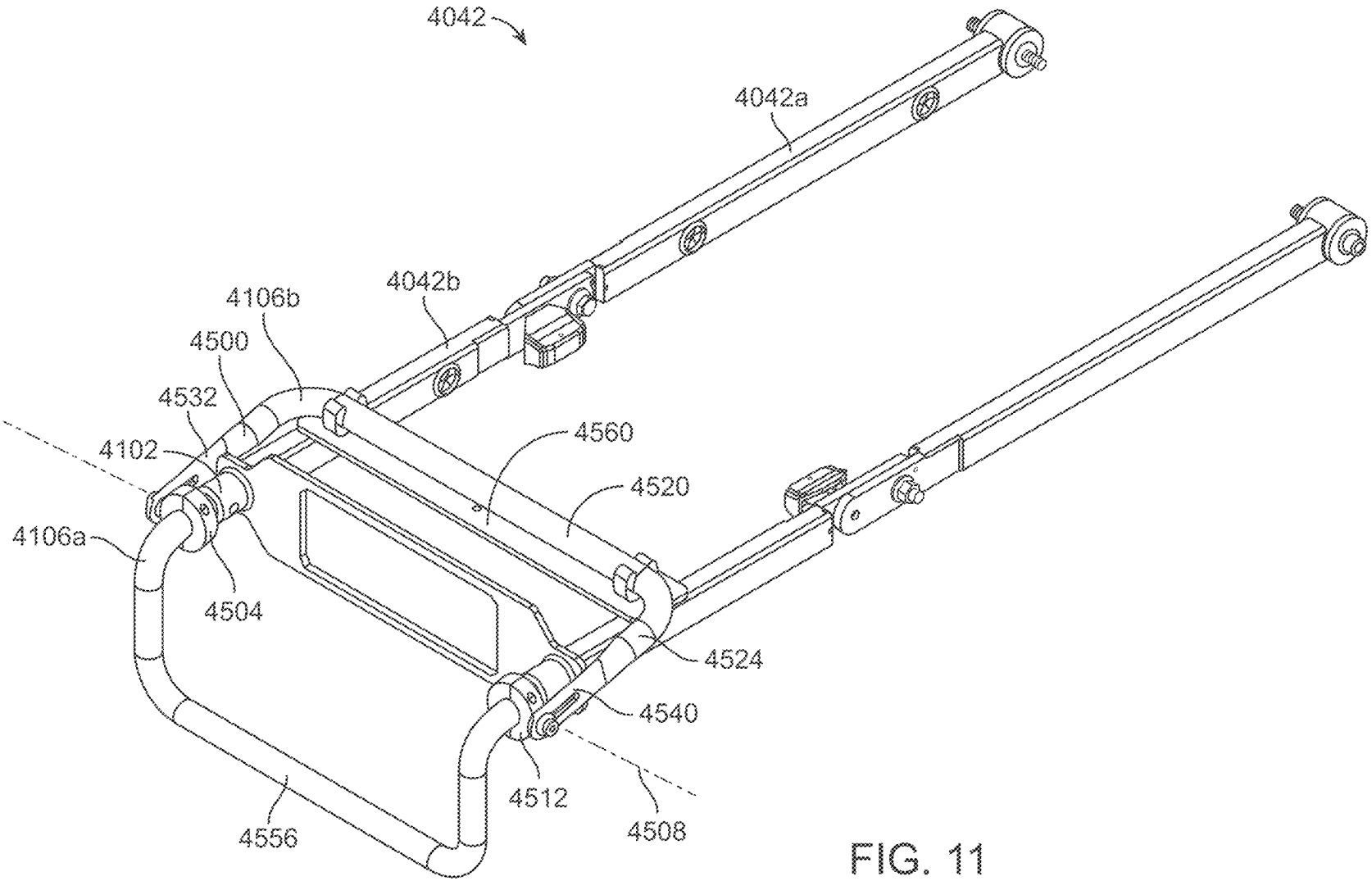
FIG. 11 is a perspective view of another embodiment of a handle.
Figure 13:
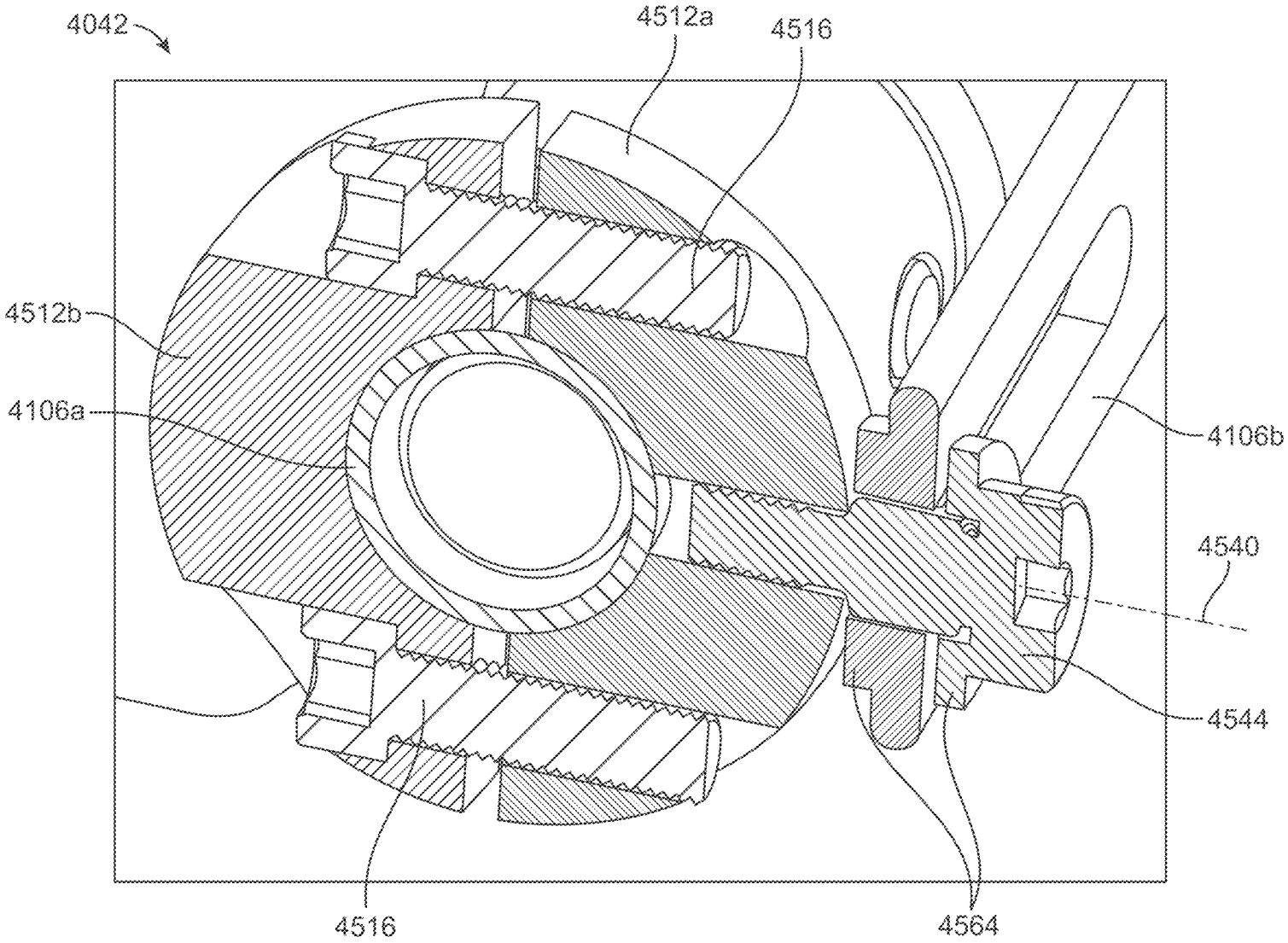
FIG. 13 is a section view taken along line 13-13 of FIG. 12.
Figure 14:
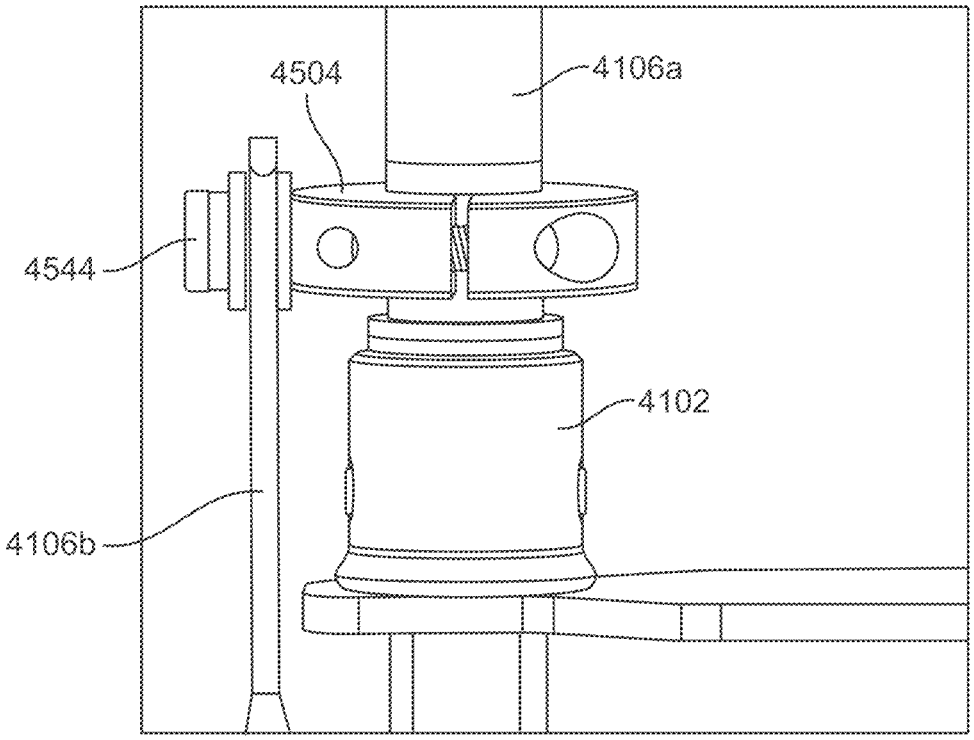
FIG. 14 is a side detail view of the mount of the handle of FIG. 11.

The secondary handle assembly 4500 includes a pair of mounts 4504 attachable to the handle 4042, and a secondary handlebar 4106*b* movably coupled to the mounts 4504. As shown in FIGS. 11 and 13, the mounts 4504 of the secondary handle assembly 4500 are releasably attachable to the handle 4042 to provide a mounting point for the secondary handlebar 4106*b*. When attached, the two mounts 4504 define an axis of rotation 4508 relative to the handle 4042. As shown in FIG. 13, the mounts 4504 include a pair of collars 4512 sized and shaped to be fixedly coupled to the primary handlebar 4106*a* proximate the vibration damping mechanism 4102. The collars 4512, in turn, include two half-annular shaped portions 4512*a*, 4512*b* that are connected to each other via one or more fasteners 4516 to capture the body of the primary handlebar 4106*a* therebetween. By attaching the mounts 4504 to the primary handlebar 4106*a* (e.g., downstream of the vibration dampening mechanisms 4102), the secondary handlebar assembly 4500 is able to gain the benefit of the two vibration dampening mechanisms 4102 to which the primary handlebar 4106*a* is already attached.

While the illustrated mounts 4504 are shown being attached to the primary handlebar 4106*a*, it is understood that in other embodiments the mounts 4504 may be attached to other points on the handle 4042 such as but not limited to, the upper handle portions 4042*b*, the lower handle portions 4042*a*, and/or any cross-members extending therebetween. Still further, the mounts 4504 may be adjustable such that the secondary handlebar assembly 4500 may be moved or mounted to different locations on the handle 4042 as desired by the end user. Still further, while the illustrated embodiment is shown being installed on a handle 4042 similar to handle 42 of FIGS. 2 and 3, it is understood that the secondary handlebar assembly 4500 may be installed on other handle designs as well.

Furthermore, while the illustrated mounts 4504 are shown as clamping collars 4512, it is understood that different forms of mounts 4504 may be used. For example, a pair of support plates (not shown) may be permanently welded to the handle 4042 in the desired location, fasteners may be directly connected to the desired handle portions 4042*a*, 4042*b*, 4106*a* (e.g., via pre-existing mounting holes formed in the handle 4042), and the like. Both permanent and non-permanent attachment styles may be used.

Figure 12:
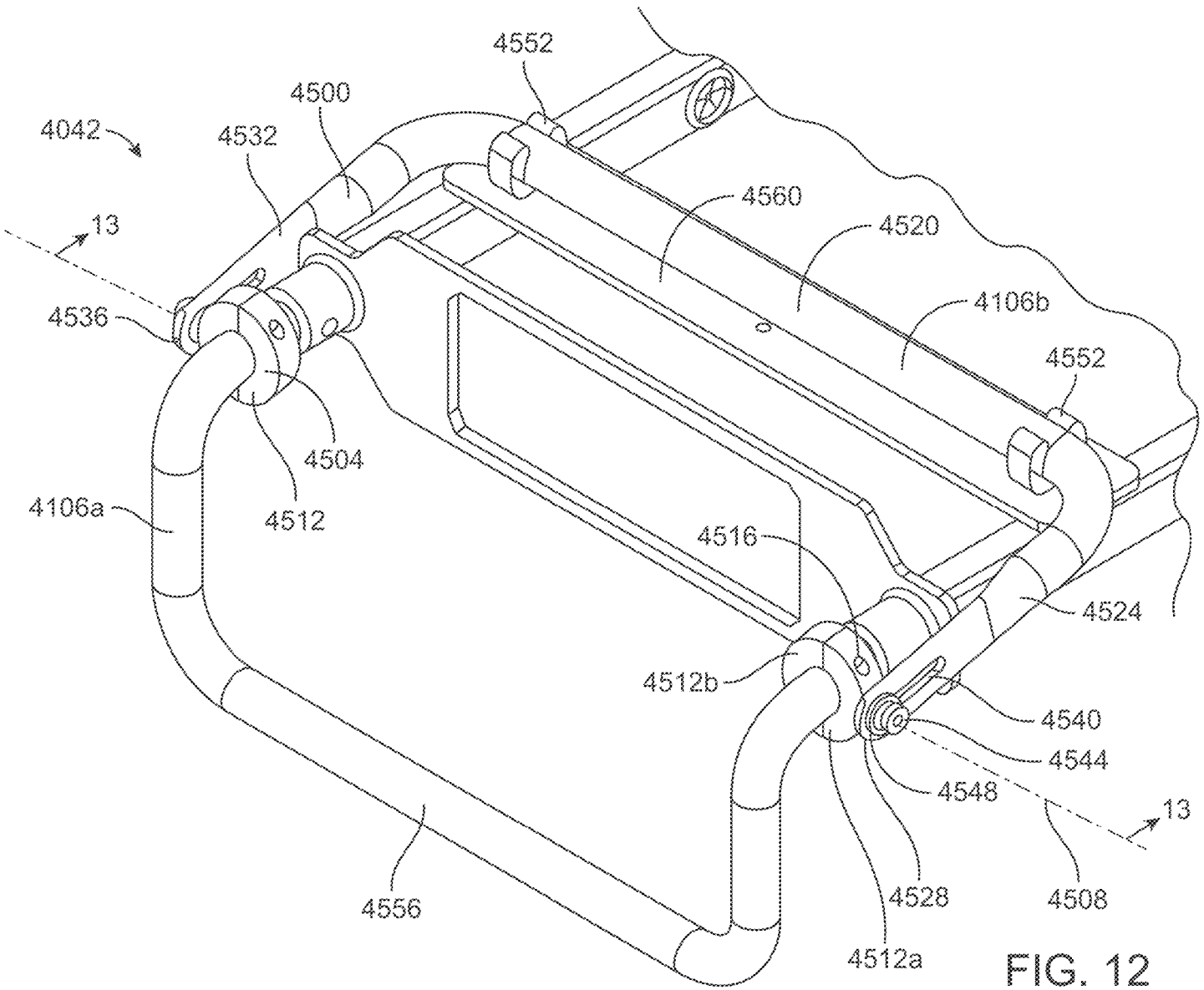
FIG. 12 is a detailed perspective view of the handlebars of the handle of FIG. 11.

As shown in FIG. 12, the secondary handlebar 4106*b* of the secondary handlebar assembly 4500 generally forms a planar, "U-shape" including a grip portion 4520, a first leg 4524 extending from one end of the grip portion 4520 to form a first distal end 4528, and a second leg 4532 extending from a second end of the grip portion 4520 opposite the first leg 4524 to form a second distal end 4536. While the illustrated handlebar 4106*b* is generally a planar-U, it is understood that in other embodiments different sizes and shapes of handlebar 4106*b* may be present.

The first leg 4524 and the second leg 4532 of the secondary handlebar 4106*b* each define an elongated slot 4540 therein positioned proximate the corresponding distal end 4528, 4536 and extending along at least a portion of the axial length of the corresponding leg 4524, 4532. Each slot 4540, in turn, is sized to receive a bolt, fastener, or other shaft 4544 therethrough to be received within or otherwise coupled to a corresponding one of the two mounts 4504. When assembled, the slots 4540 and shaft 4544 form a vibration-isolating joint to isolate the operator, when grasping only the secondary handlebar 4106*b*, from vibration transmitted through the upper handle portion 4042*b* and into the primary handlebar 4106*a*. The resulting joint 4548 also provides two degrees of freedom between the handlebar 4106*b* and the mounts 4504 when in the deployed configuration, specifically, a first degree of freedom by allowing the shaft 4544 to travel axially along the length of the slot (e.g., translational), and a second degree of freedom by rotating the handlebar 4106*b* relative to the shaft 4544 about the axis of rotation 4508.

As shown in FIG. 13, a pair of washers 4564 may be positioned between the shaft 4544 and the secondary handlebar 4106*b* to influence the amount of friction occurring therebetween. The user may tighten or loosen the shaft 4544 or change the texture of the material from which the washers 4564 to influence how much force is conveyed between the secondary handlebar 4106*b* and the handle 4042. For example, if rubber or other high-friction materials are used the user may be able to apply a greater force along the length of the slot 4540. The resiliency of the material of the washers 4564 may also influence how much vibration is conveyed through the joint 4548.

As discussed above, the illustrated location of the mounts 4504 thereby provide the secondary handlebar 4106*b* with two independent forms of vibration isolation. The first form being the vibration dampening mechanisms 4102 positioned upstream and the second form being the joint 4548 between the handlebar 4106*b* and the mounts 4504.

Figure 15:
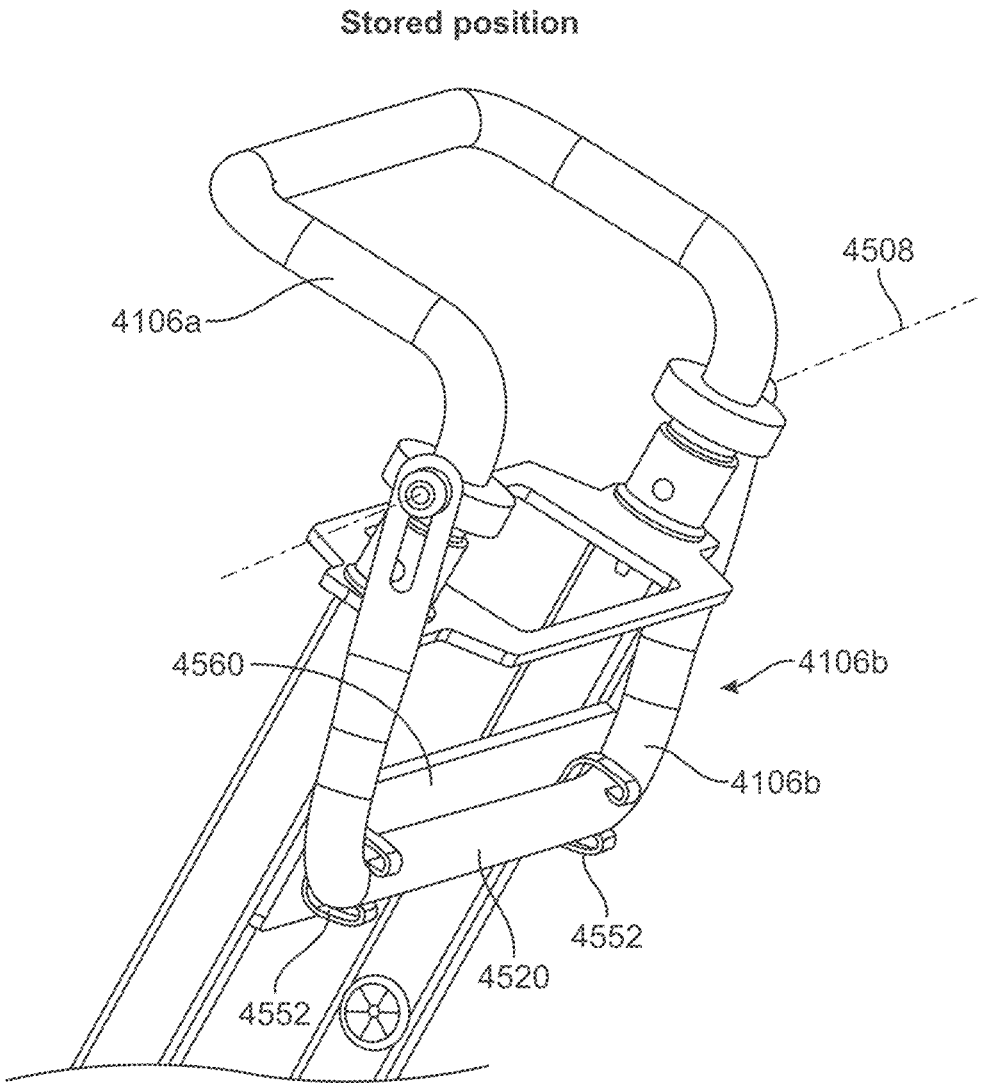
FIG. 15 is a perspective view of the handle of FIG. 11 in the stowed position.
Figure 16:
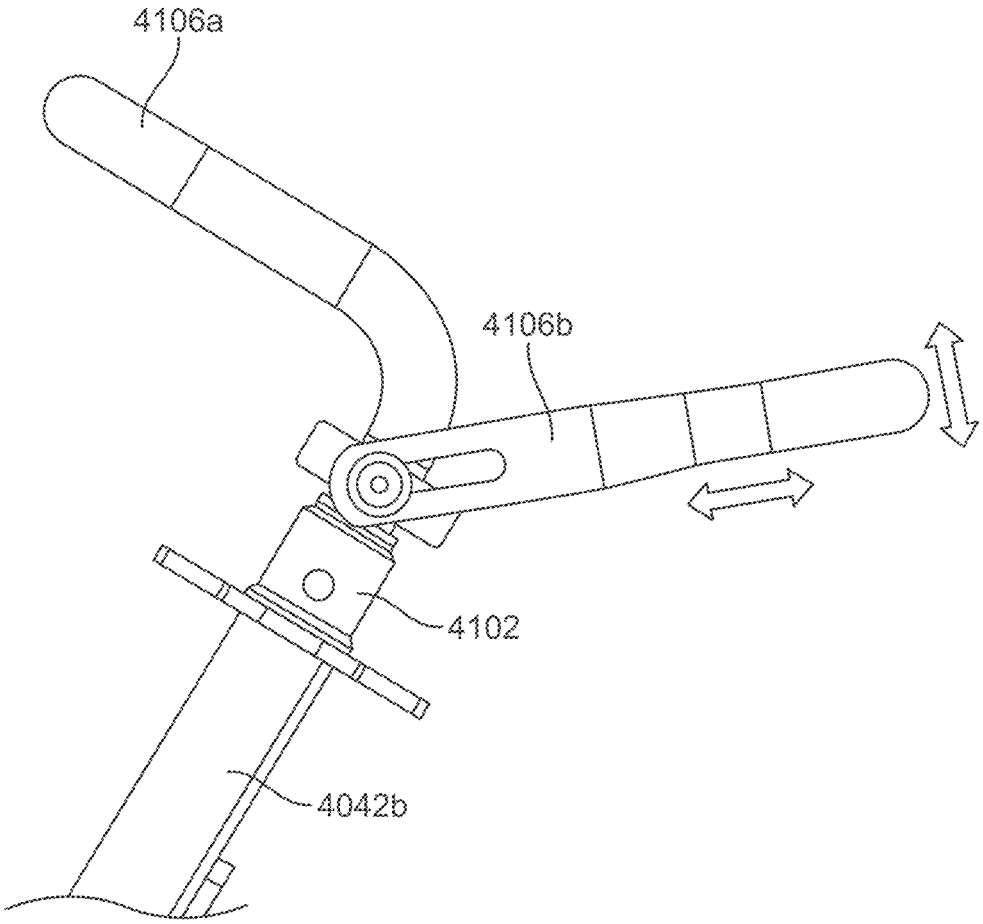
FIG. 16 is a perspective view of the handle of FIG. 11 in the deployed position.

The secondary handle assembly 4500 also includes one or more securing members or clips 4552 to secure the secondary handlebar 4106*b* in a "stowed" position in which the secondary handlebar 4106*b* is secured in place (see FIG. 15). In the illustrated embodiment, the clips 4552 are positioned so that the grip portion 4520 of the handlebar 4106*b* is positioned opposite from the grip portion 4556 of the primary handlebar 4106*a*. Stated differently, the grip portion 4520 of the secondary handlebar 4106*b* is positioned so that the axis of rotation 4508 is positioned between the grip portion 4520 of the secondary handlebar 4106*b* and the grip portion 4556 of the primary handlebar 4106*a* when the secondary handlebar 4106*b* is in the stowed position. As shown in FIG. 12, the clips 4552 of the secondary handle assembly 4500 are fixedly mounted to a crossbar 4560 that in turn is mounted to the upper handle portion 4042*b* upstream of the vibration damping mechanism 4102. In other embodiments, the clips 4552 may be fixedly mounted to other portions of the handle 4042.

The clips 4552 of the illustrated embodiment form an interference fit with the grip portion 4520 to secure the secondary handlebar 4106*b* in the stowed position. The clips 4552 may be formed of a resiliently deformable plastic, metal, or other such materials that allow for a relatively small amount of deformation when stowing the secondary handlebar 4106*b* to form the interference fit. In the illustrated embodiment, the clips 4552 are generally C-shaped. In other embodiments, the clips 4552 may be shaped differently to correspond with a different shape grip portion. While the illustrated securing members 4552 are clips, it is understood that in other embodiments different forms of retention, such as but not limited to Velcro, snaps, fasteners, and the like, may be used to secure the secondary handlebar 4106*b* in the stowed position.

Figure 17:
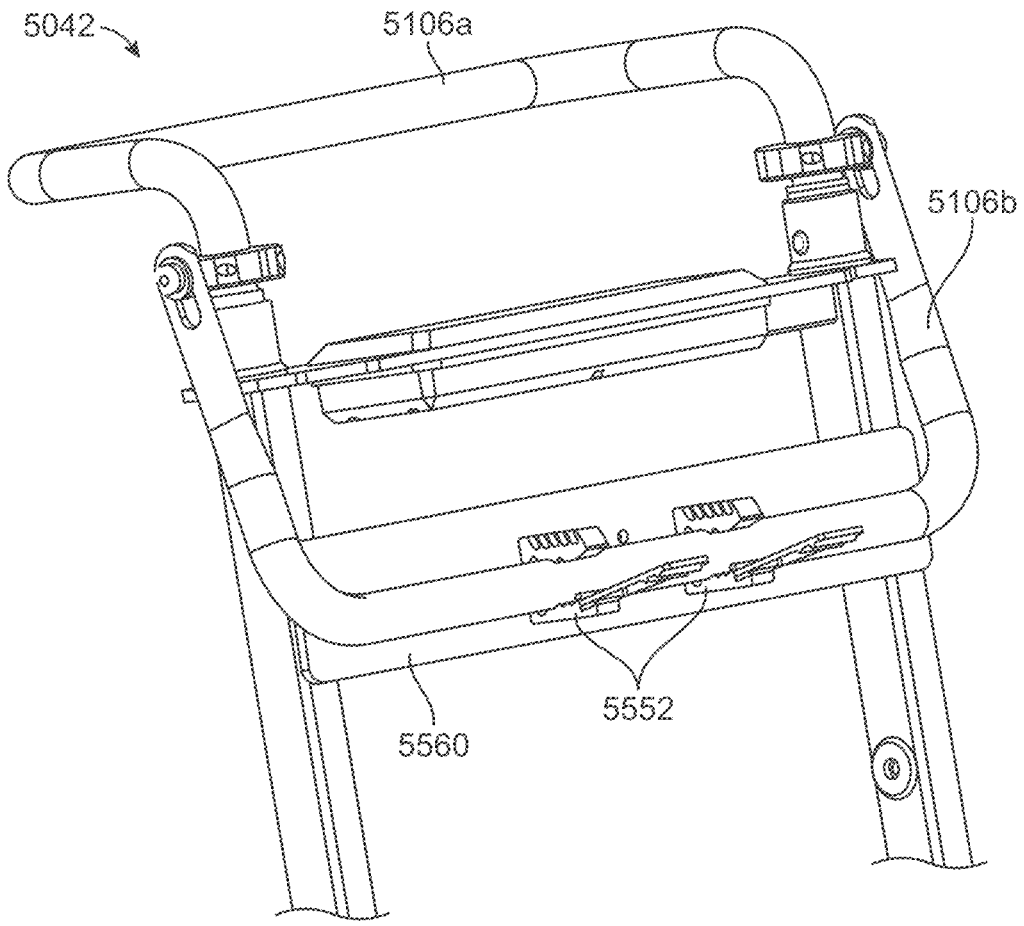
FIG. 17 is a perspective view of another embodiment of a handle in a stowed position.
Figure 18:
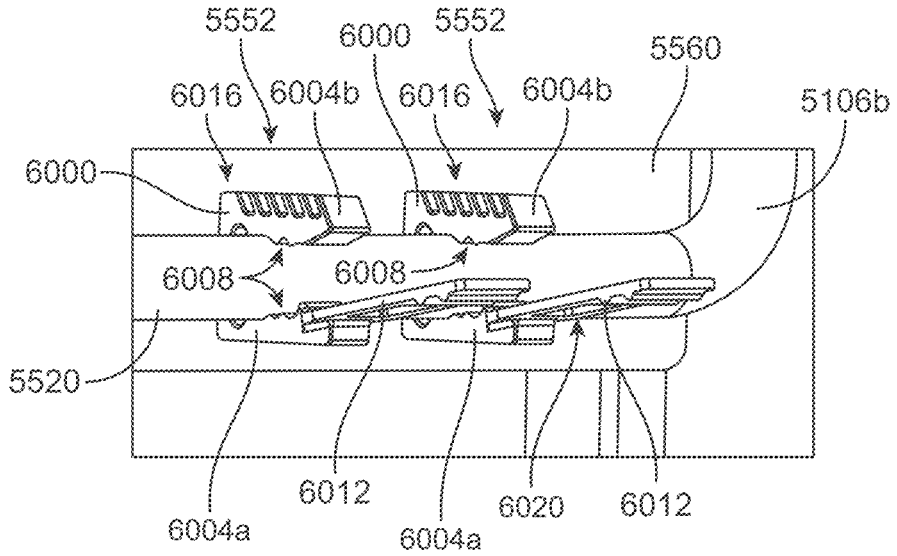
FIG. 18 is an enlarged perspective view of the handle of FIG. 17.

FIGS. 17 and 18 illustrate another embodiment of securing members 5552 in accordance with the present disclosure. The securing members 5552, and the handle 5042 to which the securing members 5552 are coupled, are generally similar to the handle 4042 and therefore only the differences will be described in detail herein. Like parts have like reference numerals, beginning with 5, rather than 4.

The securing members 5552 are fixedly mounted to a crossbar 5560 to selectively secure the secondary handlebar 5106*b* in the stowed position. Unlike the clips 4552 of the previous embodiment, the securing members 5552 are formed as straps. Each strap 5552 is C-shaped. The C-shape of each strap 5552 is formed from a base surface 6000 that is fixedly mounted to the crossbar 5560 and a pair of opposed grip arms 6004*a*, 6004*b* extending from the base surface 6000. The pair of opposed grip arms 6004*a*, 6004*b* extend parallel to one another and are spaced apart to receive the grip portion 5520 of the secondary handlebar 5106*b* therebetween. Each of the pair of opposed grip arms 6004*a*, 6004*b* includes a gripping surface, illustrated as a plurality of ridges 6008 to aid the securing members 5552 in securing the grip portion 5520 of the secondary handlebar 5106*b*. Each of the straps 5552 further includes a band 6012 extending from one of the pair of opposed grip arms 6004*a* (e.g., a lower one of the opposed grip arms 6004*a*). The other of the pair of opposed grip arms 6004*b* (e.g., a higher one of the opposed grip arms 6004*b*) includes a plurality of attachment ridges 6016. The band 6012 includes an aperture 6020 that is selectively securable to the plurality of attachment ridges 6016 when the band 6012 is wrapped around the secondary handlebar 5106*b* to prevent the handlebar 5106*b* from inadvertently separating from the securing member 5552 and rotating out of the stowed position.

To stow the handlebar 5106*b*, an operator rotates the handlebar 5106*b* to the stowed position such that the grip portion 5520 is positioned between the pair of opposed grip arms 6004*a*, 6004*b* of the straps 5552. In some embodiments, the pair of opposed grip arms 6004*a*, 6004*b* may be resiliently deformable and spaced apart such that an interference fit exists between the plurality of ridges (i.e., the gripping surface of the opposed grip arms 6004*a*, 6004*b*) and the secondary handlebar 5106*b*. The operator then wraps each band 6012 around the handlebar 5106*b* and inserts one of the attachment ridges 6016 into the aperture 6020 to secure the secondary handlebar 5106*b* in the stowed position. As should be understood by one of ordinary skill in the art, the operator may adjust a tightness of the securing member 5552 by adjusting which of one of the attachment ridges 6016 is received in the aperture 6020.

The handle 42, 1042, 2042, 4042 has been described in relation to a vibratory plate compactor 10. However, as will be understood by one having ordinary skill in the art, the handle 42, 1042, 2042, 4042 can alternatively be utilized with other walk-behind construction equipment (e.g., an early entry saw).

Although the disclosure has been described in detail with reference to certain preferred embodiments, variations and modifications exist within the scope and spirit of one or more independent aspects of the disclosure as described.

Various features and aspects of the present disclosure are set forth in the following claims.

What is claimed is:

1. A handle for a construction tool, the handle comprising:

a lower handle portion configured to be coupled to the construction tool;

an upper handle portion coupled to the lower handle portion;

a handlebar coupled to the upper handle portion, the handlebar configured to be grasped by a user during operation of the construction tool; and a vibration isolating joint positioned between the handlebar and the upper handle portion, wherein the vibration isolating joint isolates the handlebar from vibration transmitted to the upper handle portion from the construction tool, and wherein the vibration isolating joint provides a first degree of freedom to the handlebar relative to the upper handle portion and a different, second degree of freedom to the handlebar relative to the upper handle portion, wherein the vibration isolating joint includes a slot defined in one of the upper handle portion or the handlebar, and a pin coupled to the other of the upper handle portion or the handlebar, and wherein the pin is slidably received within the slot.

2. The handle of claim 1, wherein the first degree of freedom is rotation, and wherein the second degree of freedom is translation.

3. The handle of claim 1, further comprising a vibration damping mechanism disposed between the upper handle portion and the handlebar, the vibration damping mechanism including a socket coupled to one of the upper handle portion or the handlebar, a protrusion coupled to the other of the upper handle portion or the handlebar, the protrusion configured to be positioned within an interior volume of the socket, a pivot pin coupled to the socket and to the protrusion, the protrusion configured to rotate within the socket about the pivot pin, and a damper disposed between the protrusion and the socket, the damper configured to attenuate vibration from the construction tool that is transmitted to the vibration isolating joint.

4. The handle of claim 3, wherein the protrusion is capable of limited rotation about the pivot pin.

5. The handle of claim 1, wherein the handlebar is a secondary handlebar, and wherein the handle further comprises a primary handlebar coupled to the upper handle portion upstream of the vibration isolating joint relative to a vibration transmission pathway such that the vibration isolating joint does not isolate the primary handlebar from vibration transmitted through the upper handle portion, the vibration transmission pathway being defined from the construction tool to the handle.

6. The handle of claim 5, further comprising a vibration dampening mechanism configured to attenuate vibration experienced by a user when the user grasps the handle, and wherein the primary handlebar is coupled to the upper handle portion downstream of the vibration dampening mechanism.

7. The handle of claim 6, wherein the secondary handlebar is coupled to the upper handle portion downstream of the vibration dampening mechanism.

8. The handle of claim 6, wherein the primary handlebar is coupled to the upper handle portion downstream of the vibration dampening mechanism.

9. The handle of claim 1, wherein the handlebar is a first handlebar, the handle further comprising a second handlebar, wherein the vibration isolating joint includes a slot formed into the first handlebar, and a shaft passing through the slot and coupled to the second handlebar.

10. The handle of claim 9, wherein the vibration isolating joint includes a collar fixedly coupled to the second handlebar, and wherein the shaft is coupled to the collar.

11. The handle of claim 9, further comprising one or more clips fixedly coupled to the upper handle portion, and wherein the clips retain the first handlebar in a stowed position.

12. The handle of claim 11, wherein the first handlebar forms a first grip portion, wherein the second handlebar forms a second grip portion, wherein the first handlebar is rotatable about a first axis of rotation, and wherein when the first handlebar is in the stowed position, the first axis of rotation is positioned between the first grip portion and the second grip portion.

13. The handle of claim 12, further comprising a pair of mounts fixedly coupled to the second handlebar, and wherein the mounts define the first axis of rotation.

14. The handle of claim 9, wherein the first handlebar forms a planar-U shape.

15. The handle of claim 1, wherein the upper handle portion is pivotable relative to the lower handle portion.

16. A handle for a construction tool, the handle comprising:

a lower handle portion configured to be coupled to the construction tool;

an upper handle portion coupled to the lower handle portion;

a primary handlebar coupled to the upper handle portion; and a secondary handlebar coupled to the primary handlebar via a vibration isolating joint configured to provide a first degree of freedom of movement of the secondary handlebar relative to the primary handlebar and a second degree of freedom of movement of the secondary handlebar relative to the primary handlebar, the second degree of freedom of movement being different than the first degree of freedom of movement.

17. The handle of claim 16, wherein the first degree of freedom of movement is rotation, and wherein the second degree of freedom of movement is translation.

18. The handle of claim 16, further comprising a vibration damping mechanism disposed between the primary handlebar and the upper handle portion.

19. The handle of claim 16, wherein the secondary handlebar is movable between an operational position in which the secondary handlebar may be grasped by a user to manipulate the construction tool and a stowed position in which the secondary handlebar is secured in place.

20. The handle of claim 19, further comprising a securing member configured to secure the secondary handlebar in the stowed position.

21. The handle of claim 20, further comprising a crossbar coupled to the upper handle portion below the primary handlebar, and wherein the securing member is coupled to the crossbar.

22. The handle of claim 21, wherein the securing member includes a base surface coupled to the crossbar, a pair of opposed grip arms extending from the base surface, and a band extending from one of the pair of opposed grip arms, the band configured to be selectively secured to the other of the pair of opposed grip arms to selectively secure the secondary handlebar between the pair of opposed grip arms.

23. The handle of claim 22, wherein the securing member is a first securing member, and further comprising a second securing member coupled to the crossbar and spaced apart from the first securing member.

* * * * *